US010773411B2

(12) United States Patent
Dinger et al.

(10) Patent No.: US 10,773,411 B2
(45) Date of Patent: Sep. 15, 2020

(54) SLICING MACHINE

(71) Applicant: Bizerba SE & Co. KG, Balingen (DE)

(72) Inventors: Manfred Dinger, Balingen (DE); Timo Capone, Balingen (DE)

(73) Assignee: BIZERBA SE & CO. KG, Balingen (DE)

( * ) Notice: Subject to any disclaimer, the term of this patent is extended or adjusted under 35 U.S.C. 154(b) by 102 days.

(21) Appl. No.: 15/366,569

(22) Filed: Dec. 1, 2016

(65) Prior Publication Data

US 2017/0157789 A1 Jun. 8, 2017

(30) Foreign Application Priority Data

Dec. 4, 2015 (DE) ..... 10 2015 121 142

(51) Int. Cl.

| | |
|---|---|
| ***B26D 7/22*** | (2006.01) |
| ***B26D 7/06*** | (2006.01) |
| ***B26D 5/00*** | (2006.01) |
| ***B26D 1/15*** | (2006.01) |
| ***B26D 1/153*** | (2006.01) |
| ***B26D 7/08*** | (2006.01) |

(52) U.S. Cl.

CPC ..... *B26D 7/225* (2013.01); *B26D 1/15* (2013.01); *B26D 1/153* (2013.01); *B26D 5/00* (2013.01); *B26D 7/0616* (2013.01); *B26D 7/088* (2013.01); *B26D 7/22* (2013.01); *B26D 2210/02* (2013.01)

(58) Field of Classification Search

CPC ... B26D 7/0616; B26D 7/225; B26D 2210/02
See application file for complete search history.

(56) References Cited

U.S. PATENT DOCUMENTS

| | | | | |
|---|---|---|---|---|
| 2,034,971 A * | 3/1936 | Brockway | E05B 83/24 | 292/340 |
| 2,196,725 A | 4/1940 | Folk | | |
| 2,543,214 A * | 2/1951 | Wildberg | B60K 15/0406 | 200/61.81 |
| 2,840,405 A * | 6/1958 | Feltz | E05B 47/0002 | 292/122 |
| 3,371,947 A * | 3/1968 | Gridley | E05B 81/20 | 292/144 |

(Continued)

FOREIGN PATENT DOCUMENTS

| | | |
|---|---|---|
| AU | 2010101404 A4 | 3/2011 |
| CA | 939592 A | 1/1974 |

(Continued)

OTHER PUBLICATIONS

German Search Report for DE102015121142.4 dated Sep. 13, 2016—concise explanation of relevance contained within Report.

*Primary Examiner* — Kenneth E Peterson
(74) *Attorney, Agent, or Firm* — Leydig, Voit & Mayer Ltd.

(57) ABSTRACT

A slicing machine may include a carriage that can be swiveled out with a supporting plate for supporting product to be sliced, wherein a locking device locks the supporting plate releasably in the slicing position. In order to make simple operation of the slicing machine possible accompanied by a high level of operating safety, the locking device has an electrically or electromagnetically operable actuator for releasing the carriage pivot bearing.

11 Claims, 4 Drawing Sheets

(56) References Cited

U.S. PATENT DOCUMENTS 3,378,052 A * 4/1968 Dekker ..... B26D 7/30 83/69
3,831,408 A * 8/1974 Featherman ..... E05B 47/0002 70/84
3,848,907 A * 11/1974 Shiurila ..... E05B 47/0002 292/81
3,915,491 A * 10/1975 Montgomery ..... B60K 15/05 296/97.22
4,030,322 A * 6/1977 Pettit ..... B60K 15/05 70/159
4,917,418 A * 4/1990 Gokee ..... B60K 15/05 292/125
5,072,974 A * 12/1991 Henne ..... E05C 19/022 292/126
5,076,622 A * 12/1991 Detweiler ..... E05B 47/023 292/125
5,615,591 A * 4/1997 Scherch ..... B26D 7/00 83/399
5,687,626 A * 11/1997 Scherch ..... B26D 7/00 83/719
6,016,734 A * 1/2000 Koch ..... B26D 7/0616 83/468.7
7,134,937 B1 11/2006 Chen
7,188,871 B2 * 3/2007 Nemoto ..... E05B 83/30 292/170
7,234,382 B2 * 6/2007 Zhu ..... B26D 7/00 83/393
7,637,191 B2 * 12/2009 Zeeb ..... B26D 7/22 83/412
8,047,582 B1 * 11/2011 Rodgers ..... E05B 15/022 292/201
8,082,830 B2 * 12/2011 Rummel ..... B26D 7/22 83/707
9,327,420 B2 5/2016 Koch
2004/0011347 A1 * 1/2004 Ramsey ..... E05B 47/0012 126/192
2013/0025427 A1 * 1/2013 Koch ..... B26D 7/225 83/435.11
2013/0167701 A1 7/2013 Koch
2013/0192440 A1 * 8/2013 Koch ..... B26D 7/225 83/435.13
2015/0300057 A1 * 10/2015 Gillen ..... E05C 19/002 49/394

FOREIGN PATENT DOCUMENTS

DE 2100673 A1 9/1971
DE 3827404 A1 2/1990
DE 19518446 A1 11/1996
DE 29822200 U1 4/2000
DE 20118836 U1 2/2002
DE 102010026439 A1 1/2012
DE 102010050636 A1 5/2012
EP 2626178 A1 8/2013
EP 2626178 B1 8/2015
GB 1342881 A 1/1974

* cited by examiner

SLICING MACHINE

CROSS-REFERENCE TO RELATED APPLICATIONS

The present application claims priority from DE 102015121142.4 filed Dec. 4, 2015, the disclosure of which is hereby incorporated herein by reference.

BACKGROUND

The invention relates to a slicing machine according to the features of the present disclosure.

Such a slicing machine is known from EP 2 626 178 A1. This slicing machine has a carriage that can be swivelled out and is mounted such that it can pivot on a housing of the slicing machine via a two-part carriage foot. During pivoting from a cleaning position into the slicing position, the carriage is automatically locked by a spring-loaded pin. For swivelling out the carriage, the pin must be released by hand, only then is it possible to swivel the carriage out. This means that an operator needs one hand to release the pin and one hand to pivot the carriage. In the case of correspondingly heavy carriages, it can be problematical to swivel the latter out with only one hand and at the same time to bear the weight of the carriage with this hand.

The object of the invention is to create a slicing machine which has a high level of operating safety accompanied by simple and convenient operation. In particular, the slicing machine is to meet high hygiene standards at the same time.

This object is achieved according to the invention by a slicing machine and a method for controlling a slicing machine according to the features of the present disclosure.

According to the invention it is provided that the locking device has an electrically or electromagnetically operable actuator for releasing the carriage pivot bearing. Through the electrically or electromagnetically operable actuator, the locking device can be automatically released or unlocked in a controlled manner. An additional hand for operating the unlocking system is not necessary. For example, an operator can trigger the unlocking procedure automatically and then swivel the carriage or the supporting plate out with both hands. This makes a convenient and safe operation possible even in the case of slicing machines, the carriages of which have a relatively high weight.

The electrical or electromagnetic activation of the actuator to release the carriage pivot bearing can in addition be linked to further conditions or connected to individual actions in order to increase the operating safety of the slicing machine.

In an embodiment according to the invention it is therefore provided that, in the cleaning mode, first of all the stop plate is moved in front of the slicing edge of the slicing blade and the drive motor of the slicing blade is stopped, before the locking device is released in an electrically controlled manner. In the case of a carriage swivelled out into the cleaning position, access to the slicing area of the slicing blade is improved. On the one hand this makes simple cleaning possible, but on the other hand it also increases the risk of injury to cleaning staff. By only allowing the locking system to be released after the stop plate has been moved in front of the slicing edge of the slicing blade and the drive motor has been switched off, it is ensured that, during cleaning, the slicing edge of the blade is covered and the slicing blade no longer rotates. The risk of injury to cleaning staff is thereby considerably reduced in comparison with slicing machines with a purely mechanically releasable locking device. In the case of a purely mechanical locking device, for example, if incorrectly operated, the carriage can also be swivelled out while the drive motor of the slicing blade is running.

By slicing position is meant a position of the supporting plate in which the supporting plate is arranged orthogonal, i.e. perpendicular, to the slicing blade or the slicing plane. In this slicing position, product to be sliced, for example elongated foodstuffs such as sausages or cheese, is placed on the supporting plate and is fed to the slicing blade for cutting off individual slices by moving the carriage back and forth.

By cleaning position is meant a swivelled-out position of the carriage. That is, in the cleaning position, the supporting plate is arranged inclined with respect to the slicing plane and remote from the slicing blade. Thus, in the cleaning position, the surface of the supporting plate can be easily cleaned. In addition, access to the slicing blade is improved with the result that the latter can also be easily cleaned.

The slicing machine can, in an embodiment, be configured as a vertical slicer with a circular blade rotating in a vertical slicing plane.

In another embodiment, the slicing machine can be configured as an inclined slicer or gravity feed slicer, wherein a circular blade rotates in a slicing plane tilted with respect to the vertical by an angle of approx. 10 to approx. 35 degrees.

In particular it is provided that the slicing machine has a stop plate which is arranged in the slicing area and is mounted on the machine housing. The stop plate runs parallel to the slicing blade and can be adjusted transversely in order to set a desired slice thickness. The slice thickness can be set manually via a handle in that the position of the stop plate is adjusted manually via the handle. It can also be provided that the stop plate is adjusted via an electric servomotor. This embodiment has the advantage that no manual operation is required. In addition, the desired slicing thickness can be set precisely via the servomotor. Also in the case of large slicing machines, in which the weight of the stop plate is relatively high, it is advantageous to set the slice thickness via an electric servomotor.

In order to increase the ease of use of the slicing machine, it can be provided that the slicing machine comprises different operating modes. A first operating mode can, for example, be a slicing operation. A cleaning mode can be provided as a further operating mode.

Switching between the individual operating modes of the slicing machine preferably takes place automatically following the touch of a button, in that, for example, for switching on the cleaning mode, first of all an operation of a switch or of a button of a touchscreen (touch-sensitive screen) is evaluated and, as a result of the operation, the stop plate is moved in front of the slicing edge of the slicing blade in a motorized manner and the drive motor of the slicing blade is stopped, before the locking device is activated to release. It is thus possible for an operator of the slicing machine simply at the touch of a button on the one hand to transfer the slicing machine into a safe state and on the other hand to be able to swivel the carriage out easily. The cleaning mode can, for example, be switched on by operating a switch, for example a press switch or a turn-switch or a push-button. In an embodiment it can also be provided that the slicing machine has a control and/or input device with a touchscreen. For example, an icon can be displayed on the touchscreen as a button which serves for switching on the cleaning mode. By touching this icon, the slicing machine is automatically switched into the cleaning mode.

In order to ensure that the slicing blade has actually stopped in the cleaning position, it can be provided in an embodiment that, after the drive motor of the slicing blade has been stopped, a particular time is waited before the locking device is activated to release.

In a structural embodiment of the slicing machine it can be provided that the carriage has a two-part carriage foot that connects the supporting plate to the machine housing. The carriage pivot bearing is arranged on the carriage foot, in that the carriage foot has a first carriage foot part and a second carriage foot part mounted pivotably on the latter. The locking device is configured such that it connects the two carriage foot parts to each other releasably.

The operating safety is increased, for example, in that it is provided that a safety switching system co-operating with the locking device is present which is connected to a speed sensor for detecting a rotational speed of the slicing blade and/or to a slice thickness sensor for detecting a set slice thickness. The safety switching system is in particular configured such that it only makes it possible or undertakes to activate the actuator to release the carriage pivot bearing when the speed sensor detects that the slicing blade has stopped or has fallen below a limit speed and/or the slice thickness sensor detects a slice thickness setting of less than or equal to zero. The electrically operable actuator can be activated directly via the safety switching system. Alternatively, the safety switching system can also control an operation of the actuator in that, for example, it interrupts or closes a line to the supply voltage of the actuator. As speed sensor for detecting the rotational speed of the slicing blade, a speed sensor co-operating with the drive side of the drive motor of the slicing blade can be used, for example.

As speed sensor, an optical sensor, for example a light barrier, or a magnetic sensor, for example a Hall effect sensor can be used, which emits a measurement signal proportional to the rotational speed of the slicing blade. Alternatively, an evaluation of an activation of the drive motor can also take place as speed sensor in that, for example, the current consumption of the drive motor or the voltage induced in the drive motor as a result of the rotation of the slicing blade is evaluated as a measure of a rotational speed of the slicing blade.

As slice thickness sensor, for example, a switch can be used which co-operates with the stop plate and detects when the slice thickness of the stop plate is smaller than or equal to zero. Slice thickness smaller than or equal to zero means that the stop plate is arranged completely in front of the slicing edge of the slicing blade with the result that the slicing edge is covered by the stop plate. In the case of a slice thickness setting greater than zero, the slicing edge of the slicing blade is freely accessible, i.e. a slicing operation is then possible.

It is also possible for the locking device to be releasable when the slicing blade has not yet stopped, but when the rotational speed of the slicing blade has already fallen below a particular limit value, which makes it possible to clean the slicing blade relatively safely.

In an embodiment it can also be provided that the safety switch interrupts the power supply to the servomotor of the stop plate or the safety switching system prevents activation of the servomotor when the safety switch is operated. It is thereby prevented that the stop plate can be adjusted when the carriage is tipped out. It is thus ensured that the position of the stop plate is always covering the slicing edge of the slicing blade (slice thickness smaller than zero) when the carriage is tipped out.

In an embodiment it can be provided that, for locking the carriage pivot bearing, the locking device either has a catch that is arranged on a carriage part and is operable by the actuator and, in the slicing position, engages behind a projection arranged on the other carriage part, or has a pin that is arranged on a carriage part and is operable by the actuator and, in the slicing position, engages in a recess arranged on the other carriage part.

A high level of operating safety can also be guaranteed in that it can be provided in an embodiment that, on pivoting into the slicing position, the locking device automatically locks the supporting plate, in that the catch or the pin is acted upon by a spring into the locking position, and it is preferably provided that the catch or the pin has a lead-in chamfer or co-operates with a lead-in chamfer. Via the lead-in chamfer, the catch or the pin is first of all pushed back automatically against the force of the spring on bringing the supporting plate or the carriage from the cleaning position into the slicing position. Once the carriage or the supporting plate has reached the slicing position, the catch or the pin, acted upon by the spring, can then be pushed back into the locking position and thus locks the carriage or the supporting plate automatically. To release the locking system, the actuator must then be supplied with current again. For this it can be provided that, for releasing the locking system, the actuator moves the catch or the pin against the force of the spring, preferably that the catch or the pin is connected to a slide plate, wherein the actuator strikes the slide plate in order to operate the catch or the pin.

In an embodiment it can be provided that the locking device has a safety switch which, when the locking system is released, interrupts a power supply to the drive motor of the slicing blade. The safety switch prevents the drive motor of the slicing blade from being able to be accidentally set in motion when the carriage is swivelled out or the locking device is released. It is provided that, for the entire duration for which the locking device is released or while the carriage is swivelled out in the cleaning position, the safety switch remains in operation. Only when the locking system locks the carriage in the slicing position again is the safety switch released and then a power supply is again possible to the drive motor of the slicing blade.

For this it can, for example, be provided that the actuator has a linearly movable push rod, one end of which is connected to the slide plate and the other end of which operates the safety switch. Via the push rod it is ensured that, as long as the actuator is in the released position, the safety switch remains in operation and the safety switch thus interrupts the power supply to the drive motor of the slicing blade.

The position of the actuator in the released position can, on the one hand, be fixed in that the actuator is supplied with current for the entire time. On the other hand, the actuator can also be held mechanically in the released position in order to ensure, even in the case of power failure or when the power supply is switched off, that the safety switch remains in operation during the entire cleaning procedure. For example, it can be provided that the slide plate has a guide mechanism in which a fixed stud is guided in such a way that the stud holds the slide plate in a position that releases the locking system while the supporting plate is being swivelled out.

In an embodiment, the actuator can be configured as an electromagnet, preferably as a solenoid, which unlocks the carriage pivot bearing when current is supplied. It is only possible to tip the carriage out into the cleaning position by supplying current. If the power fails, the actuator remains in the locked position and tipping out of the carriage is prevented.

In an alternative embodiment it can be provided that the actuator is configured as an electric motor. In particular, the push rod can have a threaded section and the actuator can be configured as a spindle motor which drives a spindle nut co-operating with the threaded section in order to move the push rod linearly.

In order to achieve a compact design, it can be provided that the locking device is arranged completely within the carriage foot and/or the supporting plate. The locking device is preferably arranged completely within an installation space, which is enclosed on at least three sides by the carriage foot.

In particular it is provided that the carriage foot has a space inside it for receiving the locking device, which space it shields towards the outside. In particular, the space is sealed, preferably protected against water spray. For this, the carriage foot can have, for example, a U-shaped profile which surrounds the installation space on three sides in order to cover the latter. In particular, it can be provided, in the case of a voluminous supporting plate which has a certain thickness, that part of the installation space extends into the supporting plate. This also makes it possible to reduce the necessary overall height since part of the supporting plate is thus also used for the installation space of the locking device.

Embodiments can be conceived in which the locking device is controlled purely electrically. Alternatively, it can also be provided, however, that the locking device also has, in addition to the electrically operable actuator, a manually operable, in particular manually releasable, locking element. Via the additional manually releasable locking element there results a further increase in safety and a mechanically stable structure.

In an embodiment it can be provided that the carriage can be moved linearly via an electrical carriage drive. The carriage drive can be arranged in the machine housing and co-operates with the first part of the carriage foot.

In order to facilitate cleaning of the slicing machine for an operator it can be provided that the carriage can be displaced or moved manually in the cleaning position along the machine housing.

It is provided that the slicing machine according to the invention or the control method according to the invention is used for a slicing machine in the food trade and/or in the sale of fresh goods. By means of the slicing machine, foodstuffs, such as for example sausage, cheese or vegetables can be cut into slices and assembled into portions for sale. Alternatively, a use of the slicing machine according to the invention and/or of the control method according to the invention for a slicing machine is also conceivable in the case of food production in that, for example, pre-prepared portions for sale are assembled and then packaged via the slicing machine.

BRIEF DESCRIPTION OF THE DRAWINGS

Further embodiment examples of the invention are shown in the figures and described below in the associated description.

There are shown in,

FIG. 1 shows an embodiment example of a slicing machine 1 according to the invention. The slicing machine 1 has a machine housing 11 with a motor tower. At the top of the motor tower, a control and display device 15 for operating the slicing machine 1 is arranged. A drive motor, not shown, for a slicing blade 2 is received in the motor tower.

Figure 1:
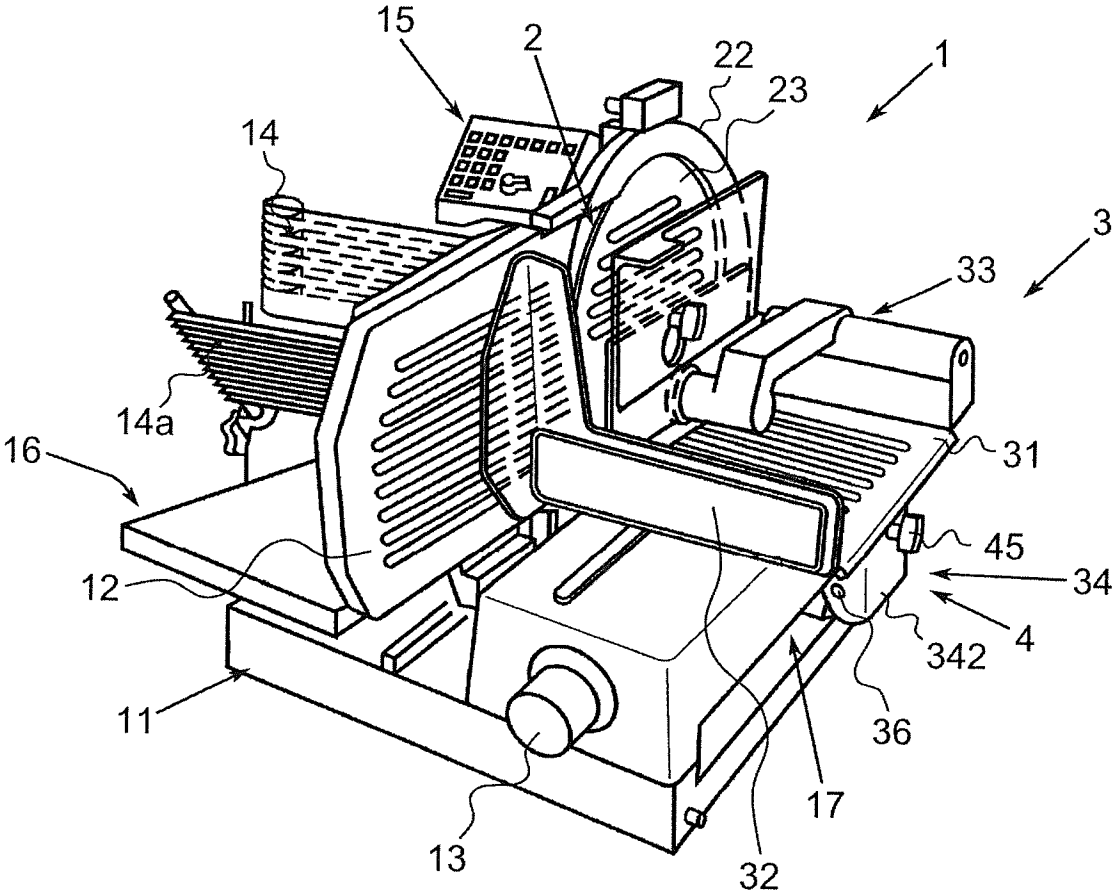
FIG. 1: a schematic view of the slicing machine according to the invention with a carriage that can be tipped out.

The slicing blade 2 is arranged in a vertically orientated slicing plane and configured as a circular blade. The slicing blade 2 is covered, in the area of its slicing edge, by an essentially C-shaped blade guard ring 22, in order to prevent unintentional contact with the slicing edge of the slicing blade 2. The flat front side of the slicing blade 2 is covered with a blade cover 23 in order to prevent accidental contact with the flat side of the rotating slicing blade 2 during the slicing operation.

The slicing area of the rotating slicing blade 2 is defined by an area left free by the blade guard ring 22. In front of this slicing area, a stop plate 12 running parallel to the slicing blade 2 and transversely displaceable is mounted on the machine housing 11. Via a handle 13, a desired slice thickness can be set by moving the stop plate 12 transversely with respect to the slicing plane. In an alternative embodiment, which is not shown in the figures, the handle can also be omitted and the stop plate is adjusted purely in a motorized manner via an electric servomotor.

A carriage 3 which can be displaced linearly parallel to the slicing plane is arranged in an area in front of the slicing blade 2. The carriage 3 has a carriage foot 34 and a supporting plate 31 for supporting product to be sliced. The supporting plate 31 is connected on its underside to the carriage foot 34. The carriage 3 is mounted displaceably on a linear guide 17 of the machine housing 11 via the carriage foot 34.

The carriage 3 comprises a hand guard 32 as well as a holder for product to be sliced 33. Both the holder for product to be sliced 33 and the hand guard 32 are formed partially transparent in order to provide an operator with a view onto the carriage 3 or onto the slicing area. Product to be sliced is placed on the surface of the supporting plate 31 and held by the holding device for product to be sliced 33. During the slicing procedure, the product to be sliced is conveyed to the slicing blade 2 by means of the holding device for product to be sliced. By moving the carriage 3 back and forth, individual slices are cut from the product to be sliced using the slicing blade 2.

The slices cut off by the slicing blade 2 are received behind the slicing blade 2 by a chain frame 14 and conveyed transversely to the slicing plane. Via a pivotable flick ejector **14*a*, the slices are removed from the chain frame 14 and deposited in a depositing area 16**.

The carriage foot 34 is configured in two parts and has a pivot bearing 35 with a pivot axle 36 in order to pivot the carriage 3 or the supporting plate 31 from the slicing position shown in FIG. 1 into a cleaning position. In the slicing position shown in FIG. 1, the carriage is locked via a locking device 4. This means that the carriage 3 cannot be brought from the slicing position into the cleaning position without releasing the locking device 4.

Figure 2:
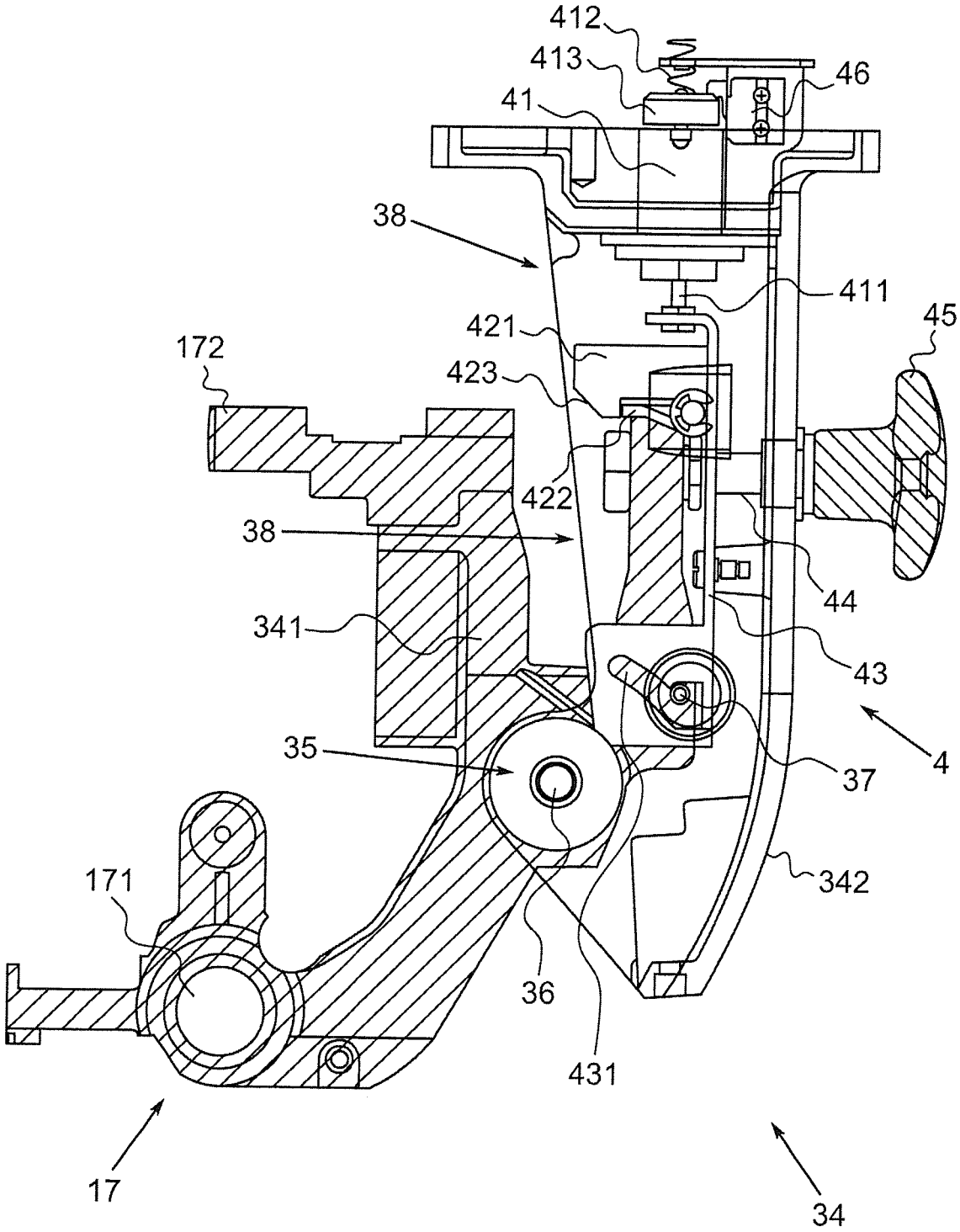
FIG. 2: a representation of the two-part carriage foot in the slicing position with a locked locking device.
Figure 3:
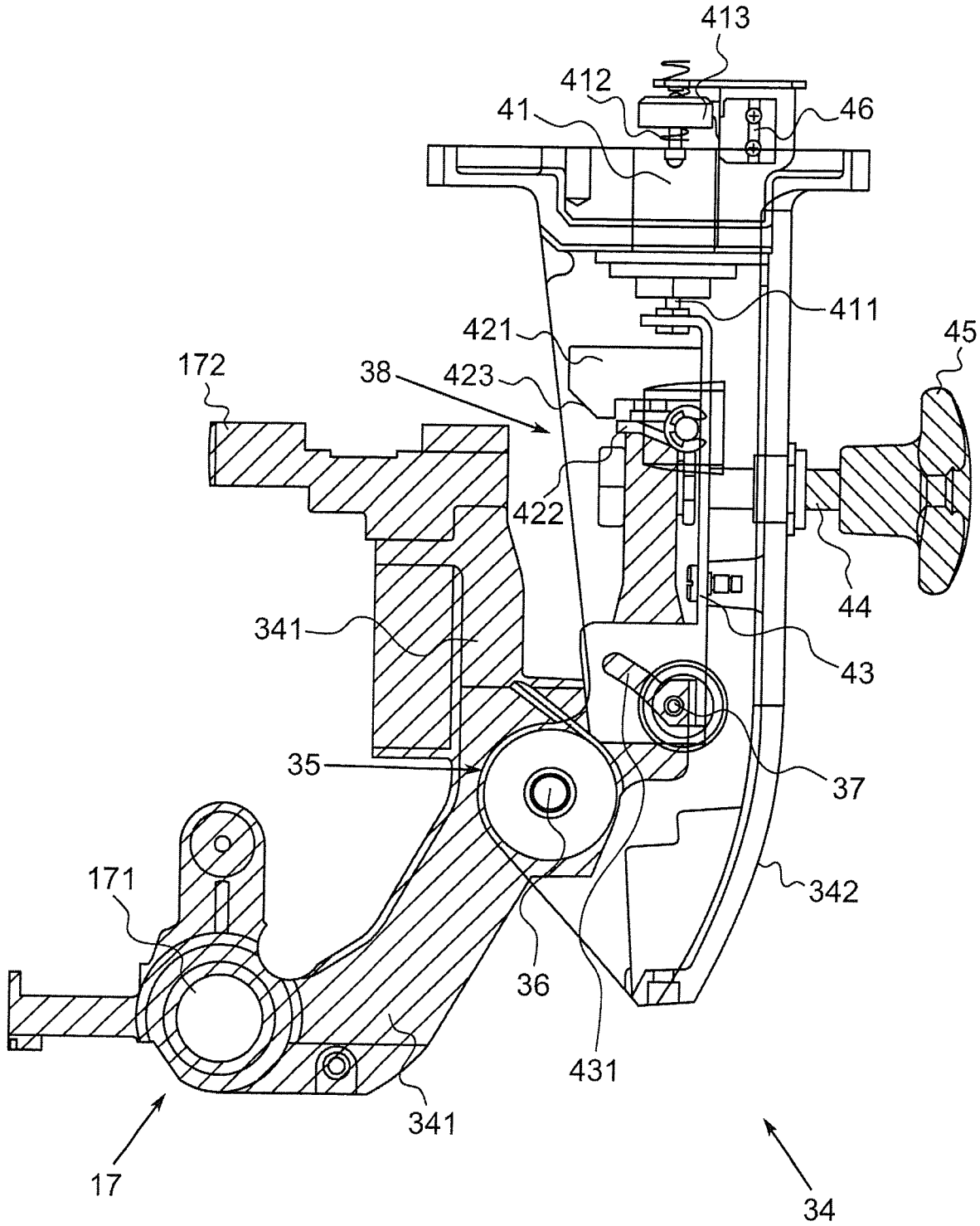
FIG. 3: a representation of the two-part carriage foot in the slicing position with a released locking device.
Figure 4:
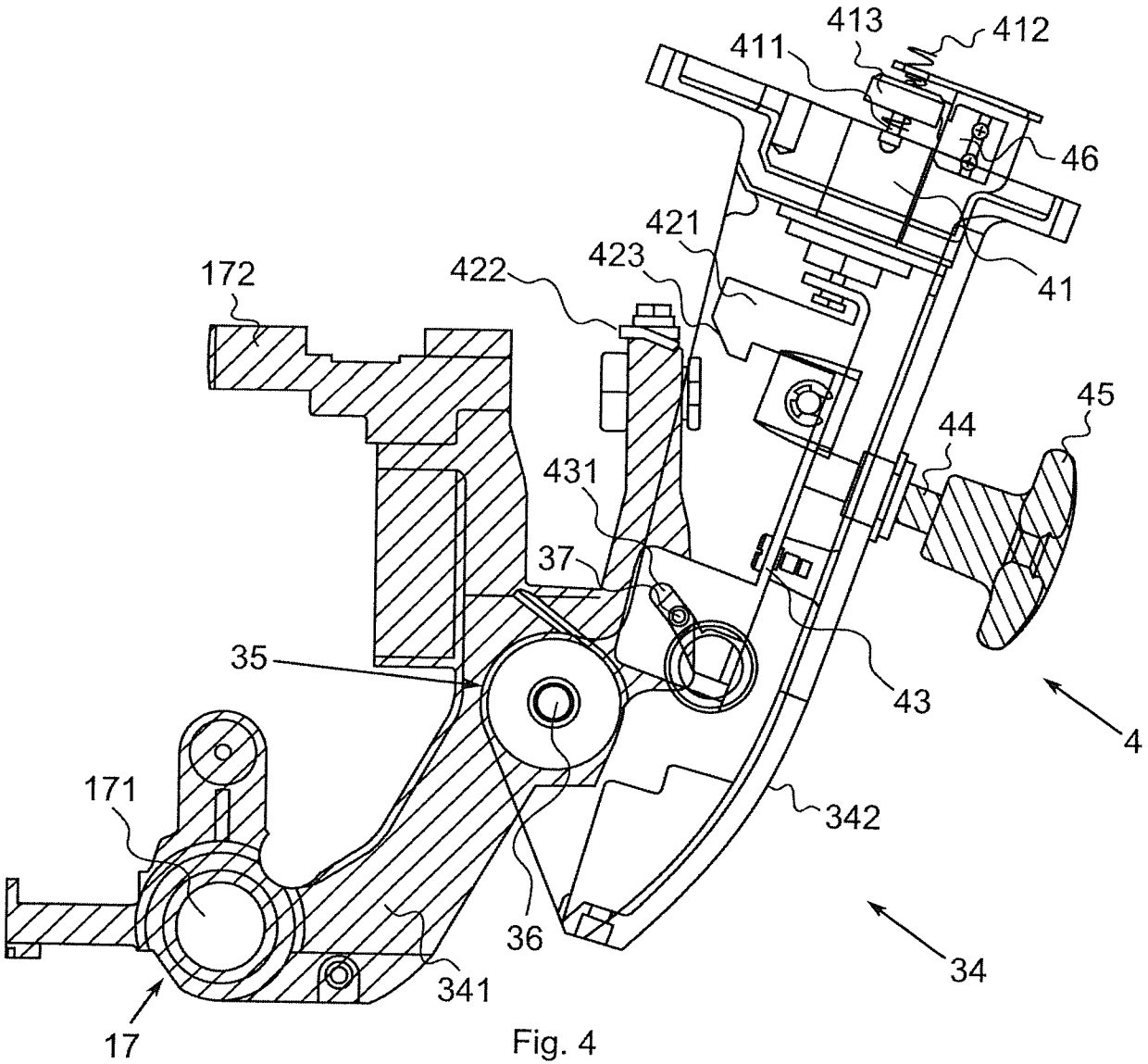
FIG. 4: a representation of the two-part carriage foot in the swivelled-out cleaning position.

In FIGS. 2 to 4, a detailed representation of the two-part carriage foot 34 is shown. The carriage foot 34 has a first carriage foot part 341 and a second carriage foot part 342 mounted pivotably on the latter. The carriage foot part 341 is mounted on the machine housing 11 via a linear guide 17 such that it is linearly displaceable. The linear guide 17 has a sliding axle 171 which forms a slide bearing for the first carriage foot part 341. A torque support 172 is arranged above the sliding axle 171 in order to support a torque arising through the weight of the carriage 3 or of the product to be sliced.

Between the first carriage foot part 341 and the second carriage foot part 342, the pivot bearing 35 is arranged with a pivot axle 36 arranged parallel to the sliding axle 171. The second carriage foot part 342 is connected to the first carriage foot part 341 via the pivot axle 36. The second carriage foot part 342 is configured as a U-shaped profile which engages around the first carriage foot part 341 and has, inside it, an installation space 38 for receiving components.

Components of the locking device 4 are arranged in the installation space 38. The locking device 4 has a slide plate 43 which is connected in one piece to a catch 421 and is mounted displaceably on the second carriage foot part 342. At the lower part of the slide plate 43, a guide mechanism 431 is provided which co-operates with a stud 37 arranged fixed on the first carriage foot part 341. On the top of the slide plate 43, this guide mechanism is connected to a push rod 411 of an electric solenoid 41. When current is supplied, the slide plate 43 is displaced upwards by the electric solenoid into the unlocking position shown in FIG. 3. When no current is supplied, the slide plate 43 is acted upon downwards by the force of a spring 412, i.e. into the locked position. It is thereby ensured that, when no current is supplied, the slide plate 43 is always pushed into the locked position.

The installation space 38 is sealed against water spray. The push rod 411 also has an O-ring as seal with the result that water spray protection according to IPX5 is achieved.

The locked position is shown in FIG. 2. In the locked position, the catch 421 engages behind a projection 422 arranged on the first carriage part 341. The second carriage part 342 is thereby locked or fixed on the first carriage part 341. In addition, as shown in FIG. 2, an additional mechanical locking system is provided, consisting of a bolt 44 and a handle 45 connected to the latter. For locking, the bolt 44 is screwed to the first carriage part 341 via the handle 45 with the result that the bolt produces a further mechanical connection between the second carriage part 342 and the first carriage part 341 supplementary to the catch 421.

To release the locking device 4, first of all the mechanical locking system is released by unscrewing the handle 45. Then, as shown in FIG. 3, the actuator 41 is supplied with current and operates the slide plate 43. That is, it pulls the slide plate 43 into the unlocking position shown in FIG. 3. The solenoid 41 is therefore working against the force of the spring 412. Alternatively, the actuator 41 can also be supplied with current first of all to release the locking device 4 and then the mechanical locking system can be released.

The electric solenoid 41 has an actuating cam 413, which co-operates with a safety switch 46, on the end of its push rod 412. The safety switch 46 serves to interrupt the power supply to the drive motor of the slicing blade 2 and/or of an electric servomotor for adjusting the stop plate 12. In the unlocking position shown in FIG. 3, the safety switch 46 is operated by the actuating cam 413. By operating the safety switch 46, the power supply to the drive motor of the slicing blade 2 and/or to the servomotor is interrupted, with the result that the slicing blade 2 can no longer be started and the position of the stop plate 12 can no longer be adjusted when the locking device 4 is released. As long as the safety switch 46 remains in operation, it is not possible to switch on the drive motor of the slicing blade 2.

To bring the carriage 3 into the cleaning position, the latter must be tilted or swivelled out. That is, starting from the slicing position shown in FIG. 3, when the locking device is released, the carriage 3 is tilted outwards with the result that the latter passes into the cleaning position shown in FIG. 4. When the carriage 3 is tipped out, the second carriage foot part 342 is pivoted relative to the first carriage foot part 341. The stud 37 therefore enters a holding section of the guide mechanism 431. The slide plate 43 is thereby prevented from being able to be pushed back out of its upper position shown in FIG. 3. The slide plate is therefore held in the unlocked position via the stud 37. The holding section of the guide mechanism 431 extends over an area which covers almost the entire pivot movement. The slide plate 43 is thus held in its upper position during the entire swivelling out procedure. At the same time it is ensured that the safety switch 46 remains in operation via the actuating cam 413 during the entire pivoting procedure.

Only when the guide stud 37 comes out of engagement with the holding section of the guide mechanism 431 shortly before reaching the slicing position, when the carriage 3 is pivoted back, can the slide plate 43 be moved downwards, acted upon by the spring 412, i.e. into the locking position shown in FIG. 2.

In order to prevent catching when pivoting the carriage 3, it is provided that the catch 421 has a lead-in chamfer 423. As long as the lead-in chamfer 423 comes into contact with the first carriage foot part 341 or the projection 422 when the carriage is pivoted back into its slicing position, the slide plate 43 is pushed upwards as a result of the lead-in chamfer 423, with the result that the catch 421 can pass without interfering with the projection 422. Only once the catch 421 has completely passed the projection 422 is the catch pushed into the locking position, acted upon by the spring 412. In the locking position, the catch 421 engages with its locking section behind the projection 422 on the first carriage foot part 341.

Thereby, on the one hand, a problem-free and catch-free pivoting of the carriage 3 is ensured and, on the other hand, it is ensured that, on pivoting the carriage 3 into the slicing position, the latter is automatically locked. Even if an operator of the slicing machine forgets to fix the additional mechanical safeguard again by turning the handle 45, the carriage 3 is nevertheless locked securely in the slicing position via the catch 421 and secured against unintentional swivelling out.

LIST OF REFERENCE NUMBERS

1 Slicing machine
11 Machine housing
12 Stop plate
13 Slice thickness setting
14 Chain frame
**14*a*** Flick ejector
15 Control and display device
16 Depositing area
17 Linear guide
171 Sliding axle
172 Torque support
2 Slicing blade
21 Blade cover
22 Blade guard ring
23 Blade cover
3 Carriage
31 Supporting plate
32 Hand guard
33 Holder for product to be sliced
34 Carriage foot

341 First carriage foot first part
342 Second carriage foot part
35 Carriage pivot bearing
36 Pivot axle
37 Stud
38 Installation space
4 Locking device
41 Actuator
411 Push rod
412 Spring
413 Actuating cam
421 Catch
422 Projection
423 Lead-in chamfer
43 Slide plate
431 Guide mechanism
44 Locking element
45 Handle
46 Safety switch

The invention claimed is:

1. A slicing machine for cutting off slices in particular of elongated product to be sliced, the machine comprising:

a machine housing which has a drive motor and a slicing blade configured to be driven in a rotating manner by the drive motor in a slicing plane, and a carriage, which is configured to be moved linearly parallel to the slicing plane, the carriage having a supporting plate configured to support the product to be sliced and a carriage foot that connects the supporting plate to the machine housing, the carriage foot comprising a first carriage foot part and a second carriage foot part;

a carriage pivot bearing, which has a pivot axle running parallel to the slicing plane, in order to pivot the second carriage foot part between a slicing position, in which the supporting plate is oriented essentially orthogonal to the slicing plane, and a cleaning position;

a locking device configured to releasably lock the carriage pivot bearing in the slicing position, the locking device comprising a slide element displaceably mounted on the second carriage foot part so as to be displaceable linearly in a direction perpendicular to the pivot axle, and an electrically or electromagnetically operable actuator configured to move the slide element between a locking position and an unlocking position; and a locking system comprising a handle and a bolt, the handle and the bolt being configured to produce a mechanical connection between the first carriage foot part and the second carriage foot part, wherein, to lock the carriage pivot bearing, the locking device has a catch that is arranged on the second carriage foot part and is operable by the actuator and, in the slicing position, engages behind a projection arranged on the first carriage foot part, such that upon a pivoting of the second carriage foot part from the cleaning position to the slicing position, the catch first passes the projection and then overhangs the projection such that the locking device releasably latches the two carriage foot parts to each other, wherein for releasing the locking device, the actuator moves the catch against the force of the spring, wherein the catch is connected to the slide element, wherein, for releasing the locking device, the actuator moves the slide element in order to operate the catch, wherein the first carriage foot part comprises a fixed stud, and wherein the slide element has a guide mechanism configured to receive the fixed stud, the fixed stud passing into and along a holding section of the guide mechanism when the second carriage foot part moves from the slicing position to the cleaning position such that engagement between the fixed stud and the holding section prevents the slide element from moving from the unlocking position to the locking position when the second carriage foot part is in the cleaning position.

2. The slicing machine according to claim 1, wherein the carriage pivot bearing is arranged on the carriage foot, and wherein the second carriage foot part is mounted pivotably on the carriage foot.

3. The slicing machine according to claim 1, further comprising a safety switching system co-operating with the locking device is connected to a speed sensor for detecting a rotational speed of the slicing blade and to a slice thickness sensor for detecting a set slice thickness, wherein the safety switching system only makes it possible or undertakes to activate the actuator to release the carriage pivot bearing when at least one of (i) the speed sensor detects that the slicing blade has stopped or has fallen below a limit speed or (ii) the slice thickness sensor detects a slice thickness setting of less than or equal to zero.

4. The slicing machine according to claim 1, wherein on pivoting into the slicing position, the locking device automatically locks the supporting plate, in that the catch is acted upon by a spring into the locking position, the catch having a lead-in chamfer or co-operating with a lead-in chamfer.

5. The slicing machine according to claim 1, wherein the locking device is arranged completely within at least one of the carriage foot or the supporting plate.

6. The slicing machine of claim 5, wherein the locking device is completely within an installation space, which is enclosed on at least three sides by the carriage foot.

7. The slicing machine according to claim 1, wherein the locking device has a safety switch which, when the locking system is released, interrupts at least one of a power supply to the drive motor of the slicing blade or a power supply to a servomotor of a stop plate, or co-operates with a safety switching system such that, when the safety switch is operated, the safety switching system prevents at least one of the drive motor of the slicing blade from being switched on or the stop plate from being adjusted.

8. The slicing machine according to claim 7, wherein the actuator has a linearly movable push rod, one end of which is connected to the slide element and the other end of which operates the safety switch.

9. The slicing machine according to claim 8, wherein the push rod has a threaded section and the actuator is configured as a spindle motor which drives a spindle nut co-operating with the threaded section.

10. The slicing machine according to claim 1, wherein the actuator is configured as an electromagnet, which unlocks the carriage pivot bearing when current is supplied.

11. The slicing machine of claim 10, wherein the actuator is configured as a solenoid.

* * * * *